United States Patent [19]

Funatogawa

[11] Patent Number: 5,026,585

[45] Date of Patent: Jun. 25, 1991

[54] MAT FOR A CHAIR

[76] Inventor: Hiroyuki Funatogawa, 3208-1 Tori 5-chome, Ashikago-City, Tochigi-Perfecture, Japan

[21] Appl. No.: 500,043

[22] Filed: Mar. 27, 1990

[30] Foreign Application Priority Data

Mar. 30, 1989 [JP] Japan ..... 1-36594[U]

[51] Int. Cl.[5] ..... B32B 3/26

[52] U.S. Cl. ..... 428/71; 428/157; 428/159; 428/316.6

[58] Field of Search ..... 428/71, 157, 159, 160, 428/316.6

[56] References Cited

U.S. PATENT DOCUMENTS 4,028,450 6/1977 Gould ..... 428/160

4,471,020 9/1984 McCarthy ..... 428/160

*Primary Examiner*—William J. VanBalen

*Attorney, Agent, or Firm*—Lorusso & Loud

[57] ABSTRACT

A mat for a chair corresponding in size to the seat of an ordinary chair has a top surface which is inclined forwardly and downwardly from its rear edge adapted for positioning normally at the bottom of the back of the chair, and a bottom surface adapted for resting normally on the seat of the chair. The top and bottom surfaces of the mat have an angle between 5° and 8° therebetween.

8 Claims, 2 Drawing Sheets

MAT FOR A CHAIR

BACKGROUND OF THE INVENTION

1. Field of the Invention

This invention relates to a mat which is laid on the seat of a chair.

2. Description of the Prior Art

When a man is standing, the spinal column forms a gentle S-shaped curve to suspend the internal organs, and the pelvis has an appropriate angle to support the spinal column in its appropriately curved form. If he sits on a chair, therefore, the pelvis fails to maintain its appropriate angle and the spinal column also ceases to maintain its appropriately curved shape. As a result, he stoops forwards, as shown in FIG. 3.

If he keeps a stooping posture for a long time, he will have a number of problems, as will hereinafter be stated:

(1) He may suffer from loss of appetite, or indigestion, as pressure bears upon the internal organs;

(2) He may lose concentration as a result of a reduction in the amount of blood carried to the brain and thereby the amount of nourishment and oxygen carried thereto; and (3) He may suffer from lumbago, since when he is seated, the lumbar region of his back receives nearly twice as heavy a load as when he is standing.

A special chair has, therefore, been proposed to overcome those problems. It is constructed as shown in FIG. 5, and comprises a forwardly and downwardly inclined seat and a knee rest which is positioned below and forwardly of the seat and is backwardly and downwardly inclined. Because of its special construction, however, this chair is expensive and is not necessarily suitable for common use in an office, or like place.

SUMMARY OF THE INVENTION

Under these circumstances, it is an object of this invention to provide an auxiliary article for a chair which is inexpensive and can be used with any existing chair to improve it as if it were a special type of chair.

This object is attained by a mat corresponding in size to the seat of an ordinary chair, and having a top surface which is inclined forwardly and downwardly from its rear edge adapted for positioning normally at the bottom of the back of the chair, and a bottom surface adapted for resting normally on the seat of the chair, the top and bottom surfaces having an angle between 5° and 8° therebetween.

The mat is simply placed on the seat of a chair normally in the way which has hereinabove been stated, and enables a person sitting on it to keep a fine posture, even if he may remain seated for a long time. The mat breaks up any load otherwise concentrated on the lumbar region of his back, so that it may bear upon his legs and arms, too. It is light in weight and is portable.

The mat can also be used in a different way. If it is so placed on the seat of the chair as to position its thick edge adjacent to the front edge of the seat, a person sitting on it can lean comfortably against the back of the chair when taking a rest, or on any other occasion.

Other features and advantages of this invention will become apparent from the following description and the accompanying drawings.

DETAILED DESCRIPTION OF THE INVENTION

Figure 1:
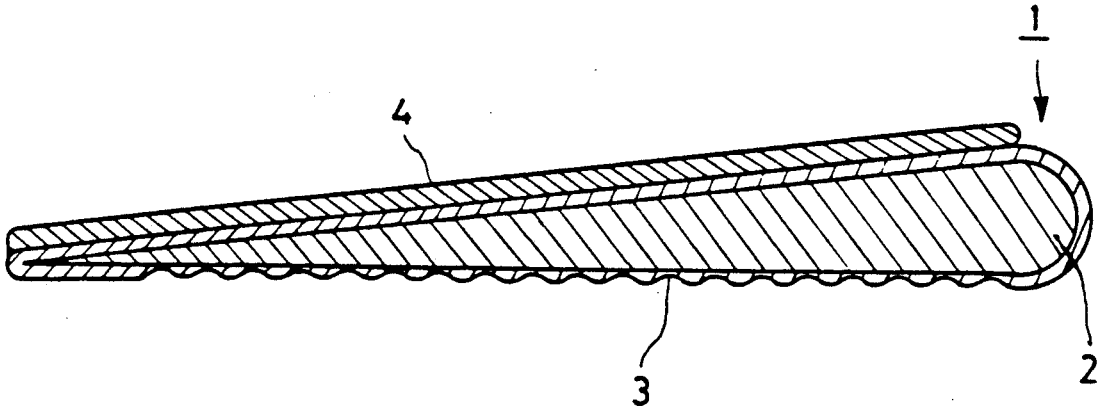
FIG. 1 is a longitudinal sectional view of a mat embodying this invention.
Figure 2:
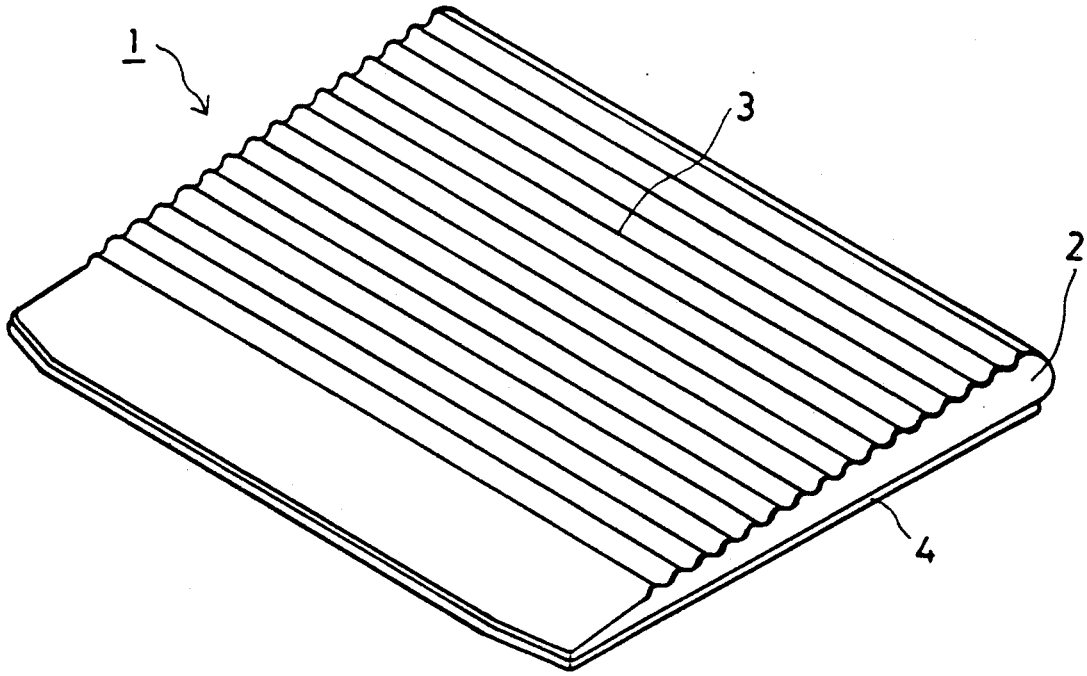
FIG. 2 is a perspective view of the mat as viewed from its bottom.

A mat embodying this invention is shown by way of example in FIGS. 1 and 2. The mat 1 comprises a rectangular core 2 formed from a polyethylene foam which is light in weight and excellent in elasticity, shock absorbing property, chemical resistance, bending and tensile strengths and heat insulating property. The core 2 corresponds in size, or longitudinal and transverse dimensions to the seat of an ordinary chair. The core 2 has a top surface which is inclined forwardly and downwardly and has an angle between 5° and 8° to its bottom surface which is supposed to be horizontally positioned when the mat 1 is used in its normal way.

One can generally be considered to have an optimum sitting posture when he is sitting on a forwardly and downwardly inclined seat surface having an angle between 3° and 6° to the horizontal. The seats of the existing chairs in general are, however, inclined backwardly and downwardly at an angle of 2° or 3° on the average to the horizontal. Therefore, it is of great significance that the top surface of the core 2, and hence of the mat of this invention, is inclined forwardly and downwardly at an angle between 5° and 8° to the horizontal.

The inclined top surface of the core 2 gives it a thickness which gradually decreases from its rear edge to its front edge. The core 2 has adjacent to its rear edge a maximum thickness that may range from 45 to 65 mm.

The core 2 has a bottom surface 3 which is preferably corrugated to allow for the passage of air between the mat 1 and anything else that may stay in contact with it. The corrugated surface 3 will be particularly useful when a person using the mat 1 wants to turn it upside down and sit on the corrugated surface 3 to acquire a better circulation of air under his hips.

A shock absorbing material 4 having a uniform thickness is preferably bonded to the top surface of the core 2. A sheet of sponge having high tensile strength can, for example, be used as the shock absorbing material 4.

The core 2 and the shock absorbing material 4 are preferably enclosed in a cover not shown. The cover preferably comprises a fabric made from antistatic fibers, so that the mat may be suitable for use by, for example, a person who works with a computer.

Figure 3:
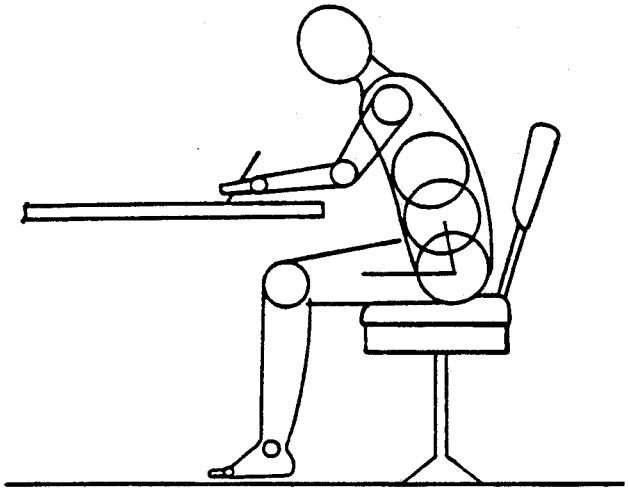
FIG. 3 is a diagrammatic side elevational view showing a person sitting on a chair.
Figure 4:
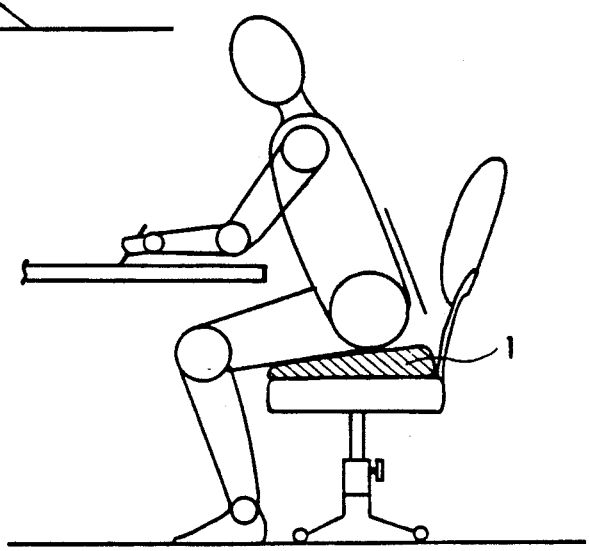
FIG. 4 is a view similar to FIG. 3, but showing a person sitting on the mat of this invention placed on a chair.
Figure 5:
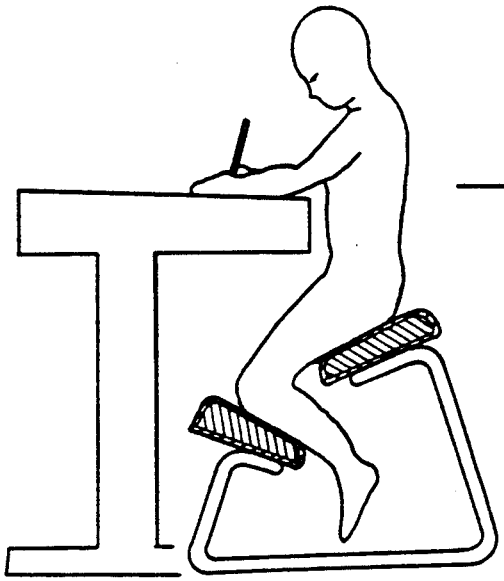
FIG. 5 is a side elevational view, partly in section, of a special chair known in the art as shown with a person sitting on it.

Everybody can easily keep his backbone straight for a long time if he sits on the mat 1 placed on the seat of a chair in its normal way of use in which it is forwardly and downwardly inclined, as shown in FIG. 4. The load which would otherwise be concentrated on the lumbar region of his back can be broken up so as to bear upon his legs and arms, too. Compare FIG. 4 with FIG. 3.

What is claimed is:

1. An auxiliary article for a chair which comprises a mat corresponding in size to the seat of an ordinary chair, and having a top surface which is inclined forwardly and downwardly from its rear edge adapted for positioning at the bottom of the back of the chair, and a bottom surface adapted for resting on said seat, said top and bottom surfaces having an angle between 5° and 8° therebetween.

2. An article as set forth in claim 1, wherein said mat comprises a rectangular core formed from a polyethylene foam, corresponding in size to said seat, and having a forwardly and downwardly inclined top surface and a bottom surface which have an angle between 5° and 8° therebetween.

3. An article as set forth in claim 2, wherein said bottom surface of said core is corrugated.

4. An article as set forth in claim 2, further including a shock absorbing material bonded to said top surface of said core.

5. An article as set forth in claim 4, wherein said shock absorbing material is a sheet of sponge having high tensile strength.

6. An article as set forth in claim 5, further including a cover in which said core and said shock absorbing material are enclosed.

7. An article as set forth in claim 6, wherein said cover is formed from a fabric of antistatic fibers.

8. An article as set forth in claim 3, further including a shock absorbing material bonded to said top surface of said core.

* * * * *